United States Patent [19]

Urata

[11] Patent Number: 4,954,429

[45] Date of Patent: Sep. 4, 1990

[54] SILVER HALIDE COLOR PHOTOGRAPHIC MATERIAL FOR LASER RECORDING

[75] Inventor: Yukihide Urata, Kanagawa, Japan

[73] Assignee: Fuji Photo Film Co., Ltd., Kanagawa, Japan

[21] Appl. No.: 263,226

[22] Filed: Oct. 27, 1988

[30] Foreign Application Priority Data

Oct. 29, 1987 [JP] Japan ..... 62-274233

[51] Int. Cl.[5] ..... G03C 1/10; G03C 7/26

[52] U.S. Cl. ..... 430/503; 430/504; 430/570; 430/945

[58] Field of Search ..... 430/503, 504, 945, 570

[56] References Cited

U.S. PATENT DOCUMENTS

| | | | |
|---|---|---|---|
| 4,006,025 | 1/1977 | Swank et al. | 96/129 |
| 4,619,892 | 10/1986 | Simpson et al. | 430/505 |
| 4,818,663 | 4/1989 | Powers et al. | 430/358 |

FOREIGN PATENT DOCUMENTS

| | | |
|---|---|---|
| 1019194 | 1/1953 | France . |
| 696474 | 9/1953 | United Kingdom . |

OTHER PUBLICATIONS

*Patent Abstracts of Japan*, vol. 11, No. 93, p. 559, (1987), JP-A-61245152.

*Patent Abstracts of Japan*, vol. 12, No. 23, p. 658, (1988), JP-A-62177547.

*Primary Examiner*—Paul R. Michl

*Assistant Examiner*—Janet C. Baxter

*Attorney, Agent, or Firm*—Sughrue, Mion, Zinn, Macpeak & Seas

[57] ABSTRACT

A color photographic material composed of a support having thereon at least one red-sensitive silver halide emulsion layer, at least one green-sensitive silver halide emulsion layer and at least one blue-sensitive silver halide emulsion layer, wherein with respect to helium-cadmium laser light having a wavelength of 441.6 nm, the ratio of the sensitivity of the green-sensitive emulsion layer to that of the blue-sensitive emulsion layer and the ratio of the sensitivity of the red-sensitive emulsion layer to that of the blue-sensitive emulsion layer are not more than 0.10;

with respect to argon laser light having a wavelength of 514.5 nm, the ratio of the sensitivity of the blue-sensitive emulsion layer to that of the green-sensitive emulsion layer and the ratio of the sensitivity of the red-sensitive emulsion layer to that of the green-sensitive emulsion layer are not more than 0.10; and with respect to helium-neon laser light having a wavelength of 632.8 nm, the ratio of the sensitivity of the blue-sensitive emulsion layer to that of the red-sensitive emulsion layer and the ratio of the sensitivity of the green-sensitive emulsion layer to that of the red-sensitive emulsion layer are not more than 0.10. The color photographic material is useful for recording laser images, such as video images, with reduced color mixing.

8 Claims, No Drawings

SILVER HALIDE COLOR PHOTOGRAPHIC MATERIAL FOR LASER RECORDING

FIELD OF THE INVENTION

This invention relates to a film used in converting an electrical signal such as a video signal into a film image, and specifically to a color photographic material used in laser film picture recording by a film picture recording means of high performance.

BACKGROUND OF THE INVENTION

Research on a technique of producing motion pictures utilizing a television system began long ago. But since the amount of information from a television system is insufficient and no excellent method was established for converting a video signal into a film image, there were only limited examples of application, and this technique did not come into widespread acceptance.

A high-grade television system and a laser film picture recording technique of unprecedented high performance have recently been developed, and a method of producing motion pictures utilizing them is of great interest.

The laser picture recording device consists of a laser light source, a light modulator, a light polarizer, a picture recording camera and a video process circuit. The principle of its operation is that three laser beams of red, green and blue whose intensities have been modulated in the light modulator according to video signals of three primary colors are synthesized into one beam by a dichroic mirror, horizontally polarized by the light polarizer, and then focused on a 35 mm film of the picture recording camera.

Details of this technique are described in Sugiura "35 mm Film Laser Picture Recording", *Technical Report of the Society of Television, OPT*169, pages 13 to 18 (1982). In laser film picture recording, a helium-neon (He Ne) laser (wavelength 632.8. nm) is used as a red color light source; an argon (Ar) laser (wavelength 514.5 nm), as a green color light source; and a helium-cadmium (He-Cd) laser (wavelength 441.6 nm), as a blue color light source. Color positive, color negative, and color internegative films for cinema are used for picture recording as described in the above-cited *Technical Report.*

These color positive, negative and internegative films, however, do not permit sufficient separation of colors among red-sensitive, green-sensitive and blue-sensitive emulsion layers with respect to the three types of laser light mentioned above (i.e., helium-neon, argon and helium-cadmium lasers). For example, if such a film is exposed to the argon laser (514.5 nm) Which is a green light source), the blue-sensitive and red-sensitive emulsion layers develop colors in addition to the green-sensitive emulsion layer, and color mixing occurs. Likewise, with the helium-cadmium laser (441.6 nm), a blue light source, the green-sensitive and red-sensitive emulsion layers develop colors in addition to the blue-sensitive emulsion layers, and color mixing occurs. If it is exposed to the helium-neon laser (632.8 nm), a red light source, blue-sensitive and green-sensitive emulsion layers develop colors in addition to the red-sensitive emulsion layer, and color mixing occurs.

SUMMARY OF THE INVENTION

It is an object of this invention to provide a silver halide color photographic material for laser picture recording with little color mixing.

According to this invention, this and other objects of the invention ar achieved by a color photographic material composed of a support having thereon at least one red-sensitive silver halide emulsion layer, at least one green-sensitive silver halide emulsion layer and at least one blue-sensitive silver halide emulsion layer, wherein with respect to helium-cadmium laser light having a wavelength of 441.6 nm, the ratio of the sensitivity of the green-sensitive emulsion layer to that of the blue-sensitive emulsion layer and the ratio of the sensitivity of the red-sensitive emulsion layer to that of the blue-sensitive emulsion layer are each at most more than 0.10;

with respect to argon laser light having a wavelength of 514.5 nm, the ratio of the sensitivity of the blue-sensitive emulsion layer to that of the green-sensitive emulsion layer and the ratio of the sensitivity of the red-sensitive emulsion layer to that of the green sensitive emulsion layer are each at most 0.10; and with respect to helium-neon laser light having a wavelength of 632.8 nm, the ratio of the sensitivity of the blue-sensitive emulsion layer to that of the red-sensitive emulsion layer and the ratio of the sensitivity of the green-sensitive emulsion layer to that of the red-sensitive emulsion layer are each at most 0.10.

DETAILED DESCRIPTION OF THE INVENTION

In the present invention, the color photographic material has the following sensitivity characteristics.

With respect to helium-cadmium laser light having a wavelength of 441.6 nm, the ratio of the sensitivity of the green-sensitive emulsion layer to that of the blue-sensitive emulsion layer and the ratio of the sensitivity of the red-sensitive emulsion layer to that of the blue-sensitive emulsion layer are each at most more than 0.10, preferably at most 0.08, more preferably at most 0.05, especially preferably at most 0.03.

With respect to argon laser light having a wavelength of 514.5 nm, the ratio of the sensitivity of the blue-sensitive emulsion layer to that of the green-sensitive emulsion layer and the ratio of the sensitivity of the red-sensitive emulsion layer to that of the green-sensitive emulsion layer are each at most 0.10, preferably at most 0.08, more preferably at most 0.05, especially preferably at most 0.03.

With respect to helium-neon laser light having a wavelength of 632.8 nm, the ratio of the sensitivity of the blue-sensitive emulsion layer to that of the red-sensitive emulsion layer and the ratio of the sensitivity of the green-sensitive emulsion layer to that of the red-sensitive emulsion layer are each at most 0.10, preferably at most 0.08, more preferably at most 0.05, especially preferably at most 0.03.

In a preferred embodiment of this invention, the silver halide grains in all of the red-sensitive, green-sensitive sensitive and blue sensitive silver halide emulsion layers have an average 9rain size of from about 0.01 to 0.4 μm, preferably not more than 0.3 μm, more preferably from about 0.05 to 0.2 μm.

In the present invention, the spectral sensitivity of the emulsion layers can be made sharp by adding sensitizing dyes at high temperatures. Known sensitizing dyes can be used. Examples of blue-sensitive sensitizing dyes that can be used in this invention are those described in U.S. Pat. No. 2,493,748, JP-B-46-30023 ("JP-B" as used herein application means an "examined Japanese patent publication"), U.S. Pat. No. 3,752,670 and 3,976,492, and JP-A-58-91444, JP-A-61-289341, and JP-A-59-55426 ("JP-A" used in this application means an "unexamined published Japanese patent application"). Examples of green-sensitive sensitizing dyes that can be used in this invention are those described in U.S. Pat. No. 3,506,443, JP-B-47-25379, JP-B43-4936 and JP-B-49-4650, and JP-A-62-139552, JP-A-61156046 and JP-A-60-128433. Examples of red-sensitive sensitizing dyes that can be used in this invention are those described in JP-B-43-4933, JP-B-46-10473 and JP-B45-32741, JP-A-59-135461, JP-A-69-214030, JP-A-61282831, JP-A-59-166955 and JP-A-59-77443 and U.S. Pat. No. 4,326,023. The temperature at which the sensitizing dyes are added is 50 to 80° C., preferably 60 to 80° C., more preferably 70 to 80° C. Preferably, the sensitizing dyes are added at the above temperatures immediately before starting chemical ripening, during chemical ripening, or immediately after the end of chemical ripening.

The sensitizing dyes used in this invention may be directly dispersed in the emulsions. Alternatively, they may be added to the emulsions in the form of a solution in a suitable solvent, methanol, ethanol, propanol, methyl cellosolve, the halogenated alcohols described in JP-A-48-9715 and U.S. Pat. No. 3,756,830, acetone, water and pyridine, or a mixture of these solvents in suitable combinations. Other methods of addition which can be used in this invention are described, for example, in JP-B-46-24185, and U.S. Pat. No. 3,822,135, 3,660,101, 2,912,343, 2,996,287, 3,429,835, 3,469,987, 3,658,546 and 3,822,135. The method described in German Patent Application No. 2,104,283 and the method described in U.S. Pat. No. 3,649,286 can also be used.

The sensitizing dyes may be uniformly dispersed in the silver halide emulsions before the emulsions are coated on a suitable support, and of course may be dispersed in any step of preparing these silver halide emulsions.

For the silver halide color photographic material, laser beams are used as blue, green and red exposing light sources. A helium-cadmium laser, an argon laser and a helium-neon laser is a typical example of suitable combination. Semiconductor solid lasers may also be used. Since these laser light beams have a high energy density, the photographic material undergoes exposure with a high illumination. This corresponds to an exposure time of $10^{-5}$ second to $10^{-8}$ second, and preferably 10-7 second. Accordingly, the term "sensitivity ratios" of the emulsion layers as used in this application refers to sensitivity ratios when the respective layers are exposed for a time of from $10^{-5}$ second to $10^{-8}$ second, and preferably $10^{-7}$ second.

The silver halide grains in the photographic emulsions used in this invention may be regular grains composed of regular crystals such as cubic, octahedral or tetradecahedral crystals, grains having an irregular crystal form such as spherical crystals, grains having a crystal defect such as a twin plane, and combined types. Mixtures of grains having various crystal forms may also be used. The silver halide emulsions used in this invention may be monodisperse emulsions having a narrow distribution or polydisperse emulsions having a broad distribution.

The average grain size of the silver halide grains used in this invention is expressed as the number average of diameters of circles having an equal area to the projected areas of the grains. The grain size can be measured by various methods. Typical method are described, for example, in "Particle Size Analysis", A.S.T.M., *Symposium of Light Microscopy*, 1955, pages 94 to 122, and T. H. James, *The Theory of the Photographic Process*, (4th edition 1977), Chapter 3, D.

The silver halide photographic emulsions that can be used in this invention may be produced by known methods, for example the methods described in *Research Disclosure*, Vol. 176, No. 17643 (December 1978), pages 22 to 23, "Emulsion Preparation and Types", and in *Research Disclosure*, Vol. 187, No. 18716 (November 1878), page 648.

The photographic emulsions used in this invention may be prepared, for example, by the methods described in P. Glafkides, *Chimie et Physicue Photographique*, (Paul Montel, 1967), G. F. Duffin, *Photographic Emulsion Chemistry* (Focal Press, 1966), and V. L. Zelikman et al., *Making and Coating Photographic Emulsion* (Focal Press, 1964). Specifically, any of the acid method, the neutral method and the ammonia method can be used in this invention. The-soluble silver salt and the soluble halogen salt may be reacted by any of the one side mixing method, the simultaneous mixing method and a combination of these. A method in which the grains are formed in the presence of an excess of silver ion (the "reverse mixing" method) may also be used. As one type of the simultaneous mixing method, there may be used a method in which the pAg of the liquid phase in which silver halide is formed is maintained constant (i.e., the controlled double jet method). According to this method, a silver halide emulsion in which the crystal form of the grains is regular and the grain size is nearly uniform can be obtained.

The emulsions may be physically ripened in the presence of a known solvent for silver halide, for example, ammonia, potassium rhodanate, and the thioethers and thione compounds described in U.S. Pat. No. 3,271,157 and JP-A-51-12360, JP-A-53-82408, JP-A-53144319, JP-A-54-100717 and JP-A-54-155828. This method can also give a silver halide emulsion in which the crystal form of the grains is regular and the grain size is nearly uniform.

Silver halide emulsions composed of the regular grains mentioned above may be obtained by controlling pAg and pH during grain formation. Details of this method are described, for example, in *Photographic Science and Engineering*, *Vol.* 6, pages 159 to 165 (1962), *Journal of Photographic Science*, Vol. 12, pages 42 to 251 (1964), and U.S. Pat. Nos. 3,655,394, and 1,413,748.

A typical monodisperse emulsion is an emulsion in which at least 95% by weight of the silver halide grains have an average grain diameter within ±40%.

It is preferred to use in this invention emulsions in which at least 95% by weight, or at least 95% by number, of the silver halide grains have an average grain diameter within the range of ±20%. Methods of producing such emulsions are described in U.S. Pat. Nos. 3,574,628 and 3,655,394 and British Patent No. 1,413,748. The monodisperse emulsions described in JP-A-48-8600, JP-A-51-39027, JP-A-51-83097, JP-A-54-48521, JP-A-54-99419, JP-A-58-37635, and JP-A58-49938 can also be used advantageously in this invention.

The crystal structure of the silver halide grains may be uniform, or the interior and outside of the grains may have different halogen compositions. Such emulsion grains are disclosed, for example, in British Patent No.1,027,146, U.S. Pat. Nos. 3,505,068 and 4,444,877, and JP-A-60 143331. The emulsions may contain silver halides of different compositions joined by epitaxial junction. Compounds other than silver halide, such as silver rhodanate and lead oxide, may be epitaxially joined. Such emulsions grains are disclosed, for example, in U.S. Pat. Nos. 4,094,684, 4,142,900, 4,459,353, 4,349,622, 4,395,478, 4,433,501, 4,463,087, 3,656,962 and 3,852,067, British Patent No. 2,036,792, and JP-A-59-162540.

Formation or physical ripening of the silver halide grains may be carried out in the presence of a cadmium salt, a zinc salt, a lead salt, a thallium salt, an iridium salt or its complex salt, a rhodium salt or its complex salt, an iron salt or its complex salt.

In particular, the iridium salt is preferably used in this invention to increase high illumination sensitivity since the photographic material of this invention is for high illumination exposure. The amount of the iridium salt is $10^{-3}$ to $10^{-10}$ mole, preferably $10^{5}$ to $10^{-9}$ mole, more preferably $10^{-6}$ to $10^{-8}$ mole, per mole of silver.

These various emulsions may be of the surface latent image type in which the latent image is formed mainly on the surface of the grains, or of the interior latent image type in which the latent image is formed inside the grains, or of the type in which the latent image is formed in both.

To remove the soluble silver salt from the emulsion before or after physical ripening, the emulsion may be subjected to noodle water washing, flocculation or ultrafiltration.

The emulsions used in this invention are usually subjected to physical ripening, chemical ripening and spectral sensitization. The additives used in these steps are described in the above-cited Research Disclosure No. 17643 (December 1978) and Research Disclosure No. 18716 (November 1979). Pertinent portions are tabulated below.

Known photographic additives that can be used in this invention are also described in the two *Research Disclosure* documents, and the pertinent portions are tabulated below.

| Type of additive | RD 17643 | RD 18716 |
|---|---|---|
| 1. Chemical sensitizer | p. 23 | p. 648, right column |
| 2. Sensitizer increasing agent | | P. 648, right column |
| 3. Bleaching agent | p. 24 | |
| 4. Antifoggant and stabilizer | pp. 24–25 | p. 649, right column |

-continued

| Type of additive | RD 17643 | RD 18716 |
|---|---|---|
| 5. Light absorber, filter dye, ultraviolet absorber | pp. 25–26 | p. 649, right column to p. 650, left column |
| 6. Stain inhibitor | p. 25 right column | p. 650, left and right columns |
| 7. Dye image stabilizer | p. 25 | |
| 8. Hardening agent | p. 26 | p. 251, left column |
| 9. Binder | p. 26 | p. 251, left column |
| 10. Plasticizer and lubricant | p. 27 | p. 650, right column |
| 11. Coating aid, and surface-activate agent | pp. 26–27 | p. 650, right column |
| 12. Antistatic agent | p. 27 | p. 650, right column |

Various couplers can be used in this invention. Specific examples are described in the patents described in the above-cited *Research Disclosure*, No. 17643, VII-C-G. As dye-forming couplers, couplers which give the three primary colors (yellow, magenta and cyan) of subtractive color photography in color development are important. Specific examples of diffusion-resistant hydrophobic 4-equivalent or 2-equivalent couplers are the couplers described in the patents disclosed in the above-cited *Research Disclosure*, No. 17643, VII-C and D. The following couplers can also be used preferably in the present invention.

Typical examples of the yellow couplers that can be used in this invention are hydrophobic acylacetamide-type couplers having a ballast group. Specific examples are described, for example, in U.S. Pat. Nos. 2,407,210, 2,875,057 and 3,265,507. In the present invention, 2-equivalent yellow couplers are preferably used. Typical examples include the yellow couplers of the oxygen atom leaving type described in U.S. Pat. Nos. 3,408,194, 3,447,928, 3,933,501, and 4,022,620, and the yellow couplers of the nitrogen atom leaving type described in JP-B-58-10739, U.S. Pat. Nos. 4,401,752 and 4,326,024, RD 18053 (April 1979), British Patent No. 1,425,020, and German Patent Publications No. (OLS) 2,219,917, 2,261,361, 2,329,587 and 2,433,812. Couplers of the α-pivaloyl acetanilide type give dyes having excellent fastness characteristics, particularly excellent light fastness, and couplers of the α-benzoyl acetanilide-type can give high color densities.

The structural formulae of specific examples of the yellow couplers that can be used in this invention are shown below. The present invention is not be construed as being limited thereto.

Specific examples of yellow couplers
Y-1
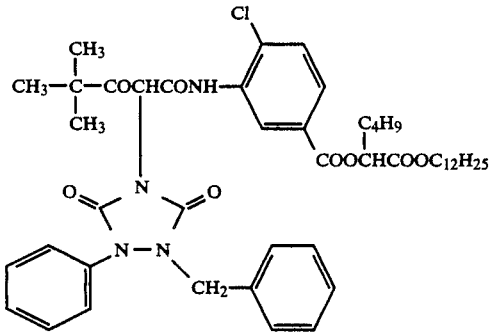
Y-2
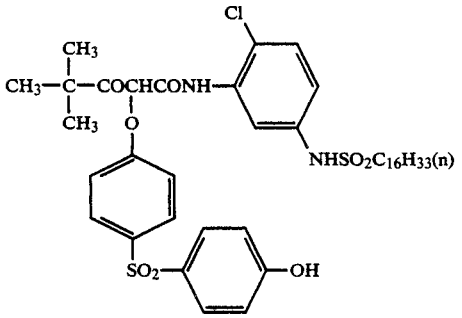
Y-3
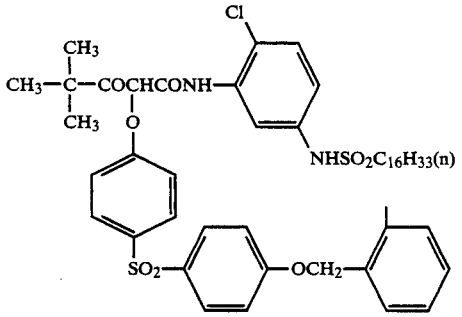
Y-4
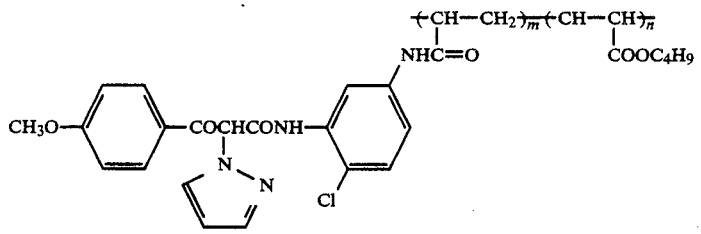
n/m = 1/1 mw ≈ 15000
Y-5
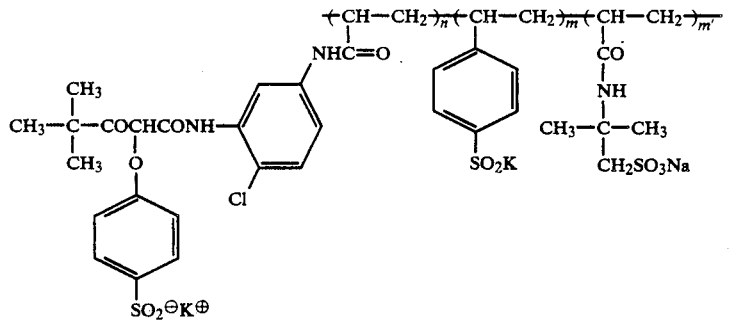
n/m + m = 1

-continued
Specific examples of yellow couplers
Y-6
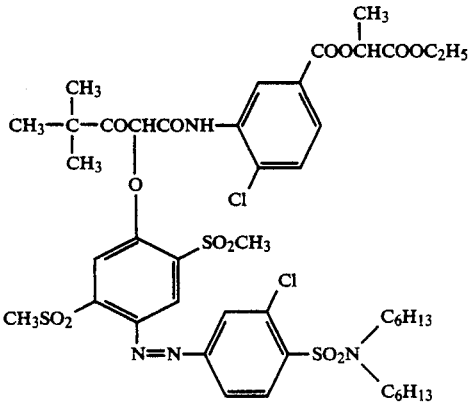
m/m = 1/6 mw ≈ 10000
Y-7
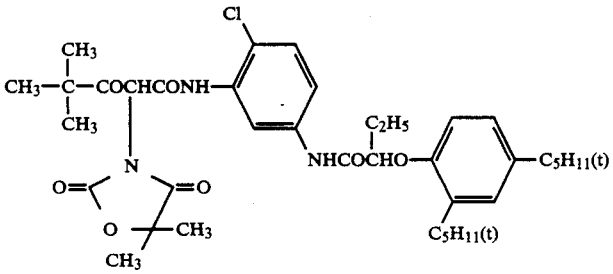
Y-8
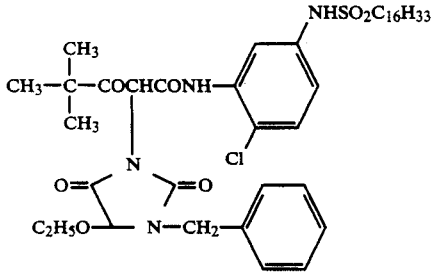
Y-9
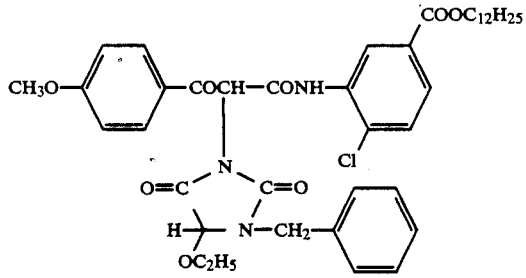
Y-10
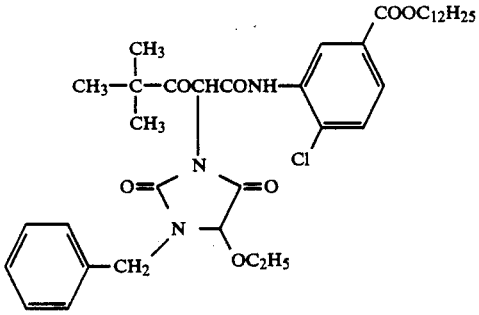
Examples of magenta couplers that can be used in this invention are ballast group-containing hydrophilic couplers of the indazolone-type or the cyanoacetyl-type, preferably the 5-pyrazolone-type and the pyrazoloazole-type. Those 5-pyrazolone-type couplers in which the 3-position is substituted by an arylamino or acylamino group are preferred from the standpoint of the color or color density of dyes developed. Typical examples are given, for example, in U.S. Pat. Nos. 2,311,082, 2,343,703, 2,600,788, 2,908,573, 3,062,653, 3,152,896 and 3,936,015. As a leaving group of 2-equivalent 5-pyrazolone-type couplers, the nitrogen atom leaving groups described in U.S. Pat. No. 4,310,619 and the arylthio groups described in U.S. Pat. No. 4,351,897 are especially preferred. A high color density can be obtained with the 5-pyrazolone-type couplers having a ballast group described in European Patent 73,636. Examples of the pyrazoloazole-type couplers are the pyrazolobenzimidazoles described in U.S. Pat. No. 3,061,432, preferably the pyrazolo[5,1-c][1,2,4]triazoles described in U.S. Pat. No. 3,725,067, the pyrazolotetrazoles described in *Research Disclosure*, No. 24220 (June 1984) and JP A-60-33552 and the pyrazolopyrazoles described in *Research Disclosure*, No. 24230 (June 1984) and JP-A-60-43659. The imidazo[1,2-b]pyrazoles described in U.S. Pat. No. 4,500,630 are preferred from the standpoint of light fastness of dyes developed and their reduced subabsorption of yellow. The pyrazolo[1,5-b][1,2,4]triazole described in European Patent No. 119,860A is especially preferred.

The structural formulae of specific examples of the magenta couplers that can be used in this invention are shown below, but the present invention is not to be construed as being limited thereto.

Specific examples of magenta couplers

M-1

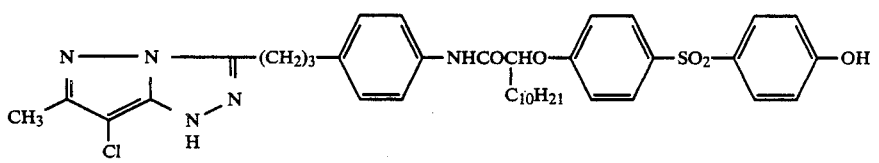

M-2

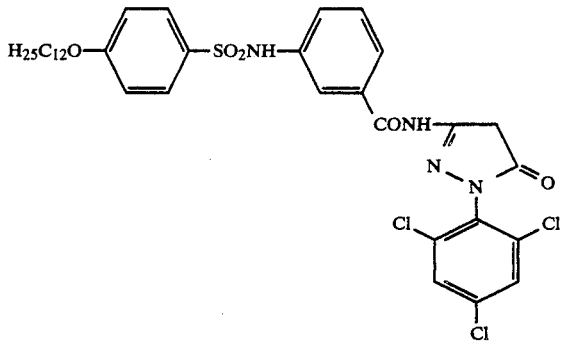

M-3

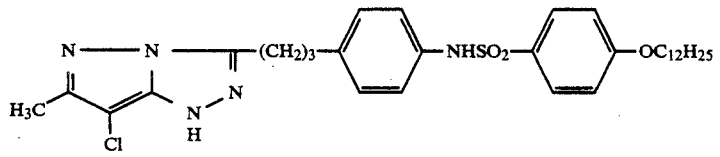

M-4

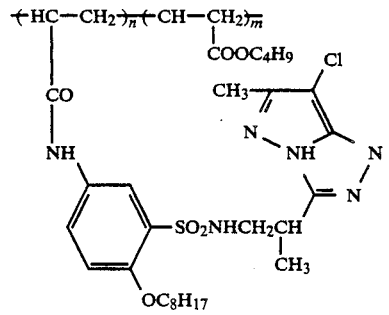

n/m = 1 Mw = 20,000

-continued
Specific examples of magenta couplers
M-5
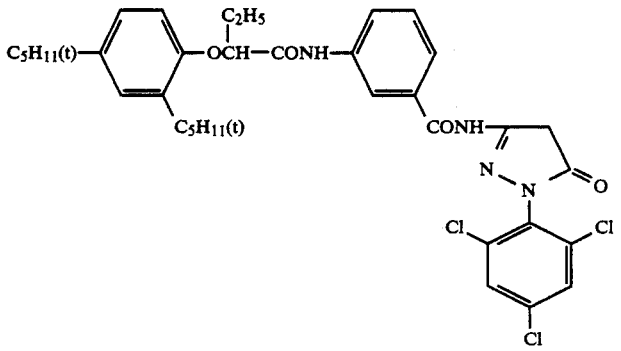
M-6
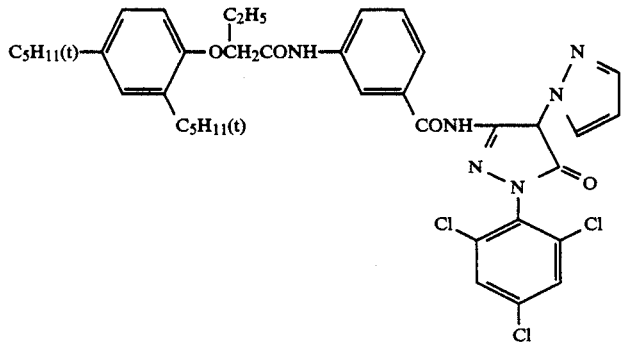
M-7
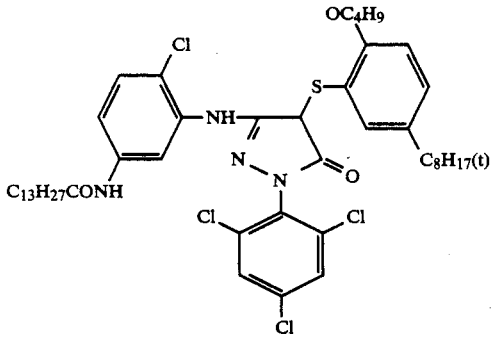
M-8
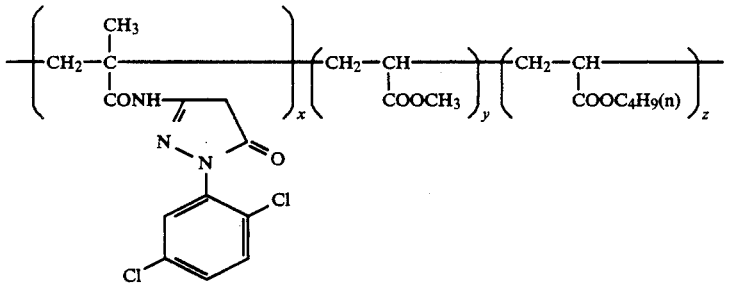
x:y:z = 50:25:25
molecular weight, about 50,000

-continued

Specific examples of magenta couplers

M-9

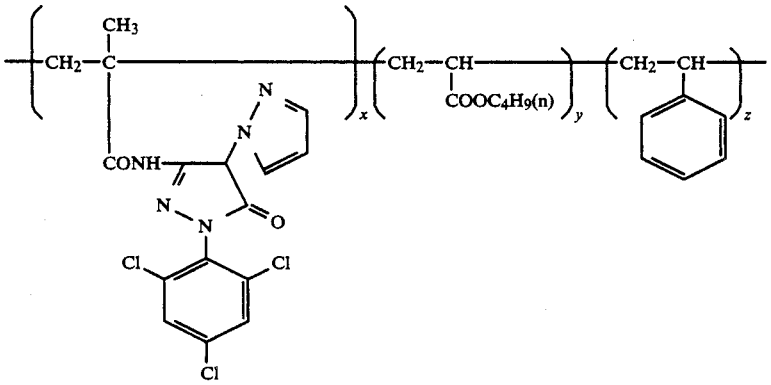

x:y:z = 50:25:25
molecular weight, about 50,000

M-10

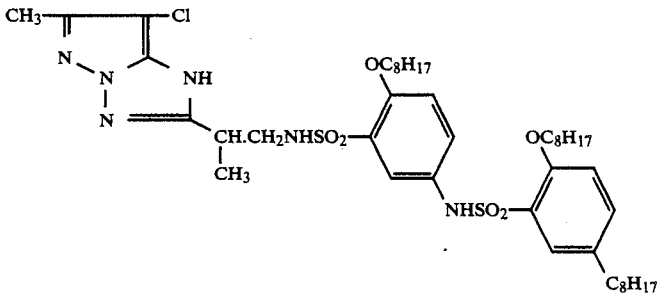

Cyan couplers that can be used in this invention are hydrophobic diffusion-resistant naphthol-type and phenol-type couplers. Typical examples include the naphthol-type couplers described in U.S. Pat. No. 2,474,293, preferably 2-equivalent naphthol type couplers of the oxygen atom leaving type described in U.S. Pat. Nos. 4,052,212, 4,146,396, 4,228,233 and 4,296,200. Specific examples of the phenolic couplers are described, for example, in U.S. Pat. Nos. 2,369,929, 2,801,171, 2,772,162, and 2,895,826.

Cyan couplers having fastness to humidity and temperature are preferably used in this invention. Typical examples include the phenolic cyan couplers having an alkyl group with at least 2 carbon atoms at the meta-position of the phenol ring which are described in U.S. Pat. No. 3,772,002, the 2,5-diacylamino-substituted phenol-type couplers described in U.S. Pat. Nos. 2,772,162, 3,758,308, 4,126,396, 4,334,011, and 4,327,173, German Patent Publication (OLS) No. 3,329,729 and European Patent No. 121,365, and the phenolic couplers having a phenylureido group at the 2-position and an acylamino group at the 5-position which are described in U.S. Pat. Nos. 3,446,622, 4,333,999, 4,451,559 and 4,427,767.

The structural formulae of specific examples of the cyan couplers that can be used in this invention are shown below, but the present invention is not to be construed as being limited thereto.

Specific examples of cyan couplers

C-1

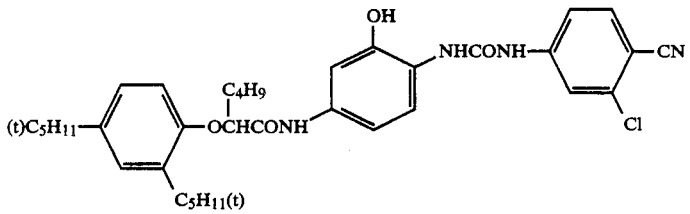

C-2

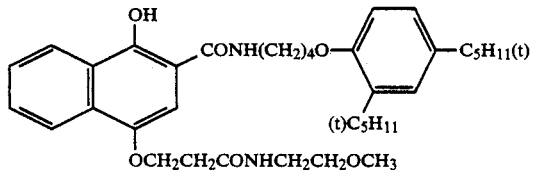

-continued
Specific examples of cyan couplers
C-3
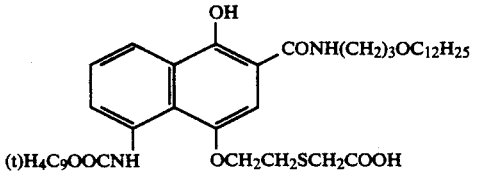
C-4
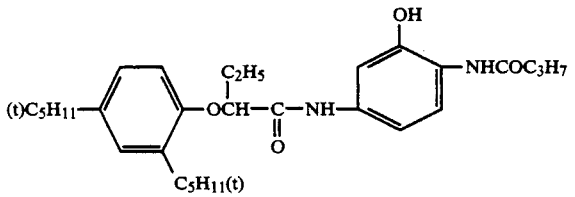
C-5
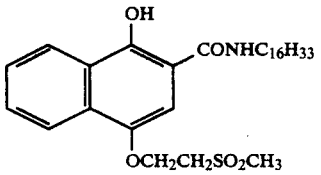
C-6
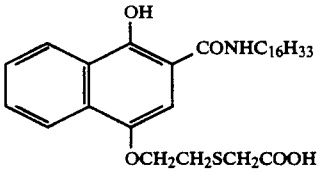
C-7
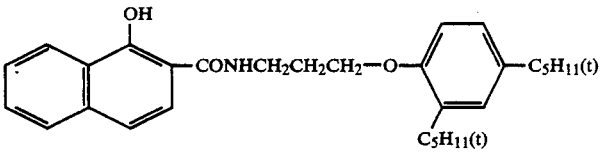
C-8
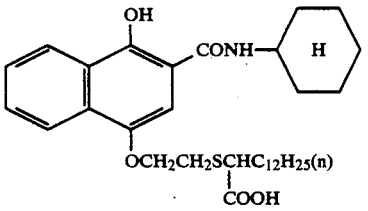
C-9
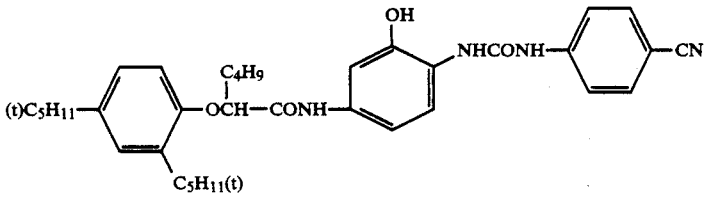

-continued

Specific examples of cyan couplers

C-10

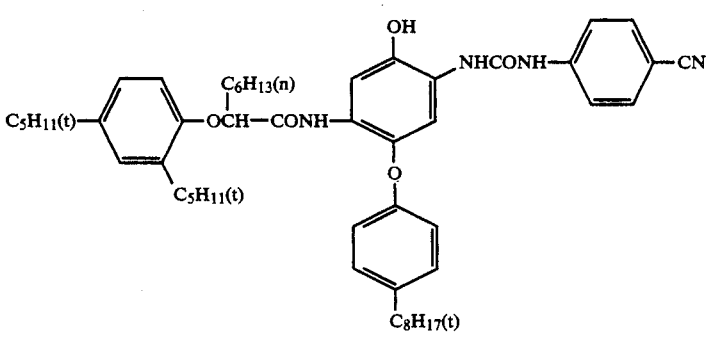

C-11

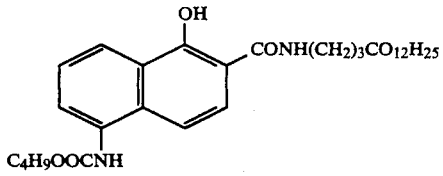

C-12

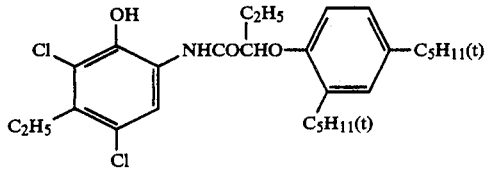

To correct unwanted absorptions of developed dyes, the color negative photographic material is preferably masked by using a colored coupler. Typical examples of the colored coupler are the yellow-colored magenta couplers described in U.S. Pat. No. 4,163,670 and JP-B-57-39413, and the magenta-colored cyan couplers described in U.S. Pat. Nos. 4,004,929 and 4,138,258 and British Patent No. 1,146,368. Other colored couplers are described in the above-cited *Research Disclosure*, No. 17643, VII-G.

Couplers which develop dyes having moderate diffusibility may be used to improve granularity. Examples of such couplers are the magenta couplers described in U.S. Pat. No. 4,366,237 and British Patent No. 2,125,570 and the yellow, magenta and cyan couplers described in European Patent No. 96,570 and German Patent Publication (OLS) No. 3,234,533.

The dye-forming couplers and the special couplers described above may form dimers or higher polymers. Typical examples of the polymerized dye-forming couplers are described, for example, in U.S. Patents 3,451,820 and 4,080,211. Typical examples of the polymerized magenta couplers are described in British Patent No. 2,102,173 and U.S. Pat. No. 4,367,282.

Couplers which release photographically useful residues as coupling proceeds can also be used preferably in this invention. Useful DIR couplers which release development inhibitors are described, for example, in the above-cited *Research Disclosure*, No. 17643, VII-F. DIR couplers which are preferably used in combination with the present invention are developing solution deactivating-type couplers, e.g., those disclosed in JP-A-57-151944, timing-type couplers, e.g., those disclosed in U.S. Pat. No. 4,248,962 and JP-A-57 154234, and reactive-type couplers, e.g., those disclosed in JP-A-60-184248. Especially preferred are the developing solution deactivating-type DIR couplers described in JP-A-57-151944, JP-A-58-217932, JP-A-60218644, JP A-60-225156 and JP A-60 233650 and the reactive-type DIR couplers described in JP-A-60-184248.

The couplers used in this invention can be introduced into the photographic material by various known dispersing methods. Typical examples are a solid dispersing method, an alkali dispersing method, preferably a latex dispersing method, more preferably an oil-in-water dispersing method. In the oil in water dispersing method, the couplers are dissolved in a high-boiling organic solvent having a boiling point of at least 175° C., or an auxiliary solvent having a low boiling point, or a mixture of both, and the solution is finely dispersed in the presence of a surface active agent in an aqueous medium such as water or an aqueous gelatin solution. Examples of the high-boiling solvent are described, for example, in U.S. Pat. No. 2,322,027. Dispersing may induce phase inversion. As required, the resulting emulsion may be coated after the auxiliary solvent is removed or decreased by distillation, noodle water washing or ultrafiltration.

The steps and effects of the latex dispersing method and examples of impregnating latices are specifically disclosed, for example, in U.S. Pat. No. 4,199,363, and German Patent Application No. (OLS) 2,541,274 and 2,541,230.

The photographic material prepared in accordance with this invention may contain a color antifoggant or a color mixing preventing agent such as hydroquinone derivatives, aminophenol derivatives, amines, gallic acid derivatives, catechol derivatives, ascorbic acid derivatives, colorless couplers or sulfonamide phenol derivatives.

The photographic material of this invention may contain various antifading agents. Typical examples of organic antifading agents include hydroquinones, 6-hydroxychromanes, 5-hydroxycoumarans, spirochromans, p-alkoxyphenols, hindered phenols represented by bisphenols, gallic acid derivatives, methylenedioxybenzenes, aminophenols, hindered amines and ether or ester derivatives resulting from silylation or alkylation of the phenolic hydroxyl groups of these compounds. Metal complexes typified by (bis-salicylaldoximato)-nickel complex and (bis-N,N-dialkyldithiocarbamato)-nickel complexes may also be used.

The multilayer color photographic material of this invention usually has at least one red-sensitive emulsion layer, at least one green-sensitive emulsion layer and at least one blue-sensitive emulsion layer on a support. The sequence of the arrangement of these layers may be selected as required. The preferred layer sequence is red-sensitive, green-sensitive and blue-sensitive layers outward from the support, or blue-sensitive, red-sensitive and green-sensitive layers from the support side. Each of the above emulsion layer may consist of two or more emulsion layers having different sensitivities. A non-light-sensitive layer may be present between two or more emulsion layers having the same sensitivity. Usually, the red-sensitive emulsion layer contains a cyan-forming coupler; the green-sensitive emulsion layer, a magenta-forming coupler; and the blue-sensitive layer, a yellow-forming coupler. As required, different combinations may be chosen.

The photographic material of this invention preferably includes auxiliary layers, such as a protective layer, an interlayer, a filter layer, an antihalation layer and a backing layer, in addition to the silver halide emulsion layers.

In the photographic material of this invention, the photographic emulsion layers and other layers are coated on a flexible support such as a plastic film, a cloth or a sheet of paper or a rigid support such as glass, ceramic or metal, which are conventionally employed. Examples of useful flexible supports include films of cellulose derivatives (cellulose nitrate, cellulose acetate and cellulose acetatebutyrate), and synthetic polymers (such as polystyrene, polyvinyl chloride, polyethylene terephthalate and polycarbonate), and sheets of paper on which a baryta layer or an α-olefin polymer (such as polyethylene, polypropylene or ethylene/butene copolymer) is coated or laminated. The support may be colored with a dye or a pigment, or blackened for the purpose of shutting off light. The surface of the support is generally undercoated in order to improve adhesion to the photographic emulsion layers. Before or after undercoating, the support may be subjected to glow discharge, corona discharge, ultraviolet irradiation, or flaming treatment.

Coating of the photographic emulsion 1.layers and other hydrophilic colloid layers may be carried out using various known coating methods such as dip coating, roller coating, curtain coating or extrusion coating. As required, the multiple layers may be simultaneously coated by the coating methods described in U.S. Pat. Nos. 2,681,294, 2,761,791, 3,526,528 and 3,508,947.

The color photographic material in accordance with this invention may be processed by usual methods described, for example, in the above-cited *Research Disclosures No.* 17643, pages 28 to 29 and No. 18716, page 651, left to right columns. After development, bleaching, and fixation (or bleach fixation), the color photographic material of this invention is subjected to a usual water rinsing treatment or stabilizing treatment.

The water rinsing step is generally carried out by countercurrent water rinsing in two or more vessels, thereby saving water. As the stabilizing treatment, the multistage countercurrent stabilizing treatment described in JP A-57-8543 (instead of the water rinsing treatment) may be cited as a typical example. In this step, 2 to 9 countercurrent baths are required. Various compounds are added to this stabilizing bath in order to stabilize the developed image. Typical examples are buffers for adjusting the pH (for example, pH 3.to 8) of the film (such as boric acid salts, meta-boric acid salts, borax, phosphoric acid salts, carbonate salts, potassium hydroxide, sodium hydroxide, aqueous ammonia, monocarboxylic acid, dicarboxylic acid and polycarboxylic acids in combination) and formalin. As required, there may be used various additives, for example, water softeners (such as inorganic phosphoric acid, aminopolycarboxylic acids, organic phosphoric acids, aminopolyphosphoric acid and phosphonocarboxylic acids), fungicides (such as benzoisothiazolinones, isothiazolones, 4-thiazolinebenzimidazoles and halogenated phenols), surface active agents, fluorescent whitening agents and hardeners. Two or more compounds for the same or different purposes may be used jointly.

As film pH adjusting agents used after the treatment, it is preferred to add various ammonium salts such as ammonium chloride, ammonium nitrate, ammonium sulfate, ammonium phosphate, ammonium sulfite and ammonium thiosulfate.

The following specific examples illustrate the present invention in greater detail, but the present invention is not to be construed as being limited .

EXAMPLE 1

First to fifteenth layers below were coated on a triacetate film base 130 μm thick in the following sequence to prepare a color photographic material.

1st layer: antihalation layer (gelatin layer containing black colloidal silver)

2nd layer: gelatin interlayer

3rd layer: 1st red-sensitive emulsion layer

To a silver iodobromide emulsion (monodisperse emulsion of cubic crystal grains; silver iodide 3.5 mole%; average grain size 0.25 μm}was added $3.6\times10^{-3}$ mole, per mole of silver, of sensitizing dye A at 40° C. A cyan coupler emulsion containing coupler C-1 and coupler C-2 (mole ratio 4.1:1.0) was added. The coating was effected such that the mole ratio of silver to the coupler mixture was 3.0, and the amount of silver coated was 0.2 g/m$^2$.

4th layer: 2nd red-sensitive emulsion layer

To a silver iodobromide emulsion (monodisperse emulsion of cubic crystal grains; silver iodide 3.5 mol%; average grain size 0.43 μm) was added $1.7\times10^{-4}$ mole, per mole of silver, of sensitizing dye A at 40° C. A cyan coupler emulsion containing coupler C-1 was added. The coating was effected so that the mole ratio of silver to the coupler was 4.0,- and the amount of silver coated was 0.1 g/m$^2$.

5th layer: 3rd red-sensitive emulsion layer

To a silver iodobromide emulsion (monodisperse emulsion of cubic crystal grains; silver iodide 3.5 mole%; average grain size 0.55 μm) was added 1.3× −4 mole, per mole of silver, of sensitizing dye A at 40° C. A cyan coupler emulsion containing coupler C-1 was added. The coating was effected such that the mole ratio of silver to the coupler was 20.0, and the amount of silver coated was 0.3 g/m$^2$.

6th layer: gelatin interlayer

7th layer: 1st green-sensitive emulsion layer

To a silver iodobromide emulsion (monodisperse emulsion of cubic crystal grains; silver iodide 4.5 mole%; average grain size 0.3 μm) was added $5\times10-4$ mole, per mole of silver, of sensitizing dye B at 40° C. A magenta coupler emulsion containing couplers C-3, C-4 and C-5 (mole ratio 4.5:1.7:1.0) was added. The coating was effected such that the mole ratio of silver/coupler was 8.0 and the amount of silver coated was 0.4 g/m$^2$.

8th layer: 2nd green-sensitive emulsion layer

To a silver iodobromide emulsion (monodisperse emulsion of cubic crystal grains; silver iodide 4.0 mole%; average grain size 0.4 μm) was added $3.4\times$ $-4$ mole, per mole of silver, of sensitizing dye B at 40° C. A magenta coupler emulsion containing couplers C-3, C-4, C-5 and C-6 (mole ratio 8.6:3.6:1.9:1.0) was added. The coating was effected such that the mole ratio of silver/coupler mixture was 8.0 and the amount of silver coated was 0.1 g/m$^2$.

9th layer: 3rd green-sensitive emulsion layer

To a silver iodobromide emulsion (monodisperse emulsion of cubic crystal grains; silver iodide 3.5 mole%; average grain size 0.5 μm) was added $3.4\times10^{-4}$ mole, per mole of silver, of sensitizing dye B at 40° C. A magenta coupler emulsion containing couplers C-3, C-4, C-5 and C-6 (mole ratio 8.6:3.6:1.9:1.0) was added. The coating was effected such that the mole ratio of silver/coupler mixture was 20.0 and the amount of silver coated was 0.3 g/m$^2$.

10*th layer: yellow filter layer (gelatin layer containing yellow colloidal silver)*

11th layer: 1st blue-sensitive emulsion layer

To a silver chloroiodkobromide emulsion (monodisperse emulsion of cubic crystal grains; silver iodide 1.0 mole%; silver chloride 5.0 mol%; average grain size 0.41 μm) was added $1.\times10^{-5}$ mole, per mole of silver, of sensitizing dye C at 40° C. A yellow coupler emulsion containing coupler C-7 was added. The coating was effected so that the mole ratio of silver/coupler was 2.0 and the amount of silver coated was 0.2g/m$^2$.

12th layer: 2nd blue-sensitive emulsion layer

To a silver chloroiodobromide emulsion (monodisperse emulsion of cubic crystal grains; silver iodide 1.0 mole%; silver chloride 5.0 mole%; average grain size 0.5 μm) was added $9.6\times10^{-6}$ mole, per mol of silver, of sensitizing dye C at 40° C. A yellow coupler emulsion containing coupler C-7 was added. The coating was effected such that the mole ratio of silver/coupler was 6.0 and the amount of silver coated was 0.3 g/m2.

13th layer: 3rd blue-sensitive emulsion layer

To a silver iodobromide emulsion (monodisperse emulsion of cubic crystal grains; silver iodide 1.0 mole%; average grain size 0.6 μm) was added $8\times10^{-6}$ mole, per mole of silver, of sensitizing dye C at 40° C. A yellow coupler emulsion containing coupler C-7 was added. The coating was effected such that the mole ratio of silver/coupler was 35.0 and the amount of silver coated was 0.4 g/m$^2$.

14th layer: 1st protective layer (gelatin protective layer containing a substantially non-light-sensitive silver halide emulsion having an average grain size of 0.08 μm).

15the layer: 2nd protective layer (gelatin protective layer)

Furthermore, 4-hydroxy-6-methyl-1,3,3*a*,7-tetrazaindene (stabilizer) ($3\times10^{-3}$ mol/Agmol), hardening agent C-8 (2 wt% of the weight of the gelatin) and a coating aid (1 wt% of the weight of the gelatin) were successively added to each emulsion layers to prepare a sample 1 (comparison).

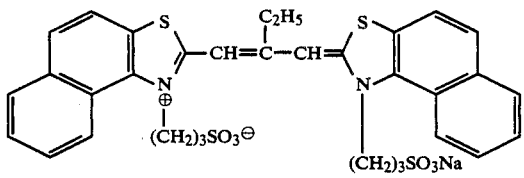

Sensitizing dye A

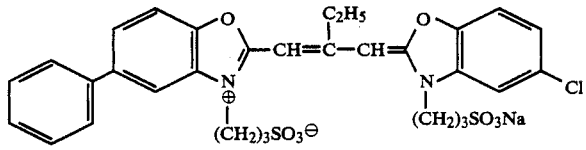

Sensitizing dye B

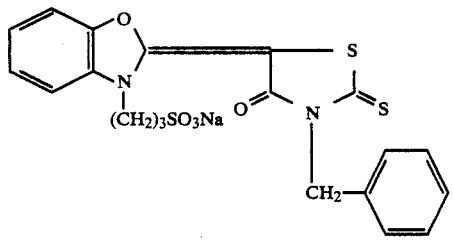

Sensitizing dye C

-continued
Coupler C-1
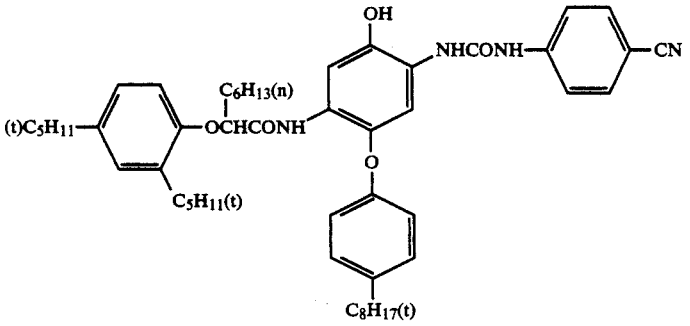
Coupler C-2
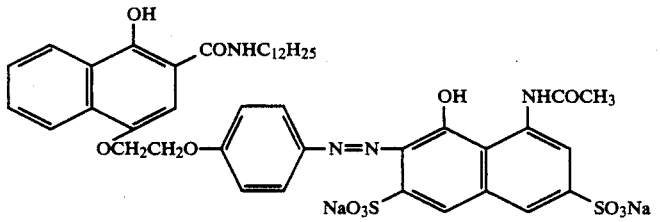
Coupler C-3
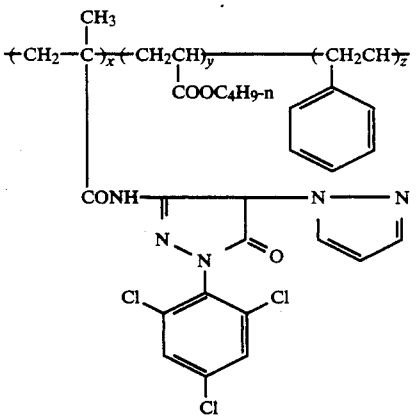
x:y:z = 1:2:2
molecular weight, about 50,000
Coupler C-4
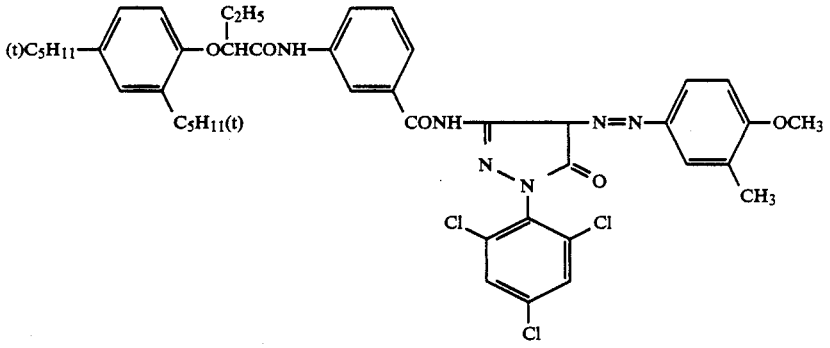

-continued

Coupler C-5

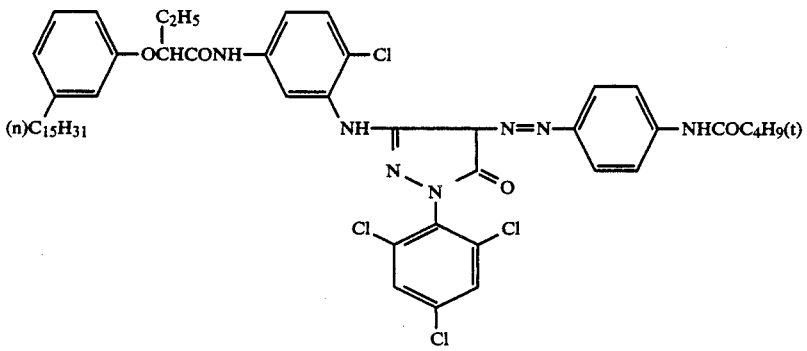

Coupler C-6

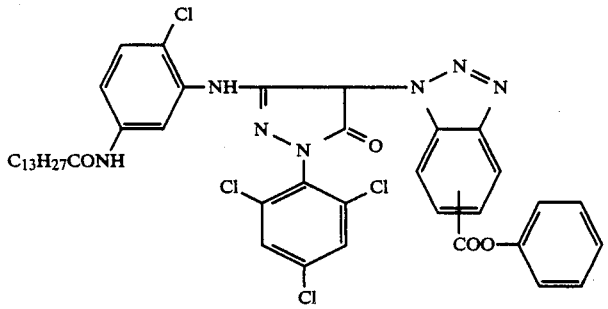

Coupler C-7

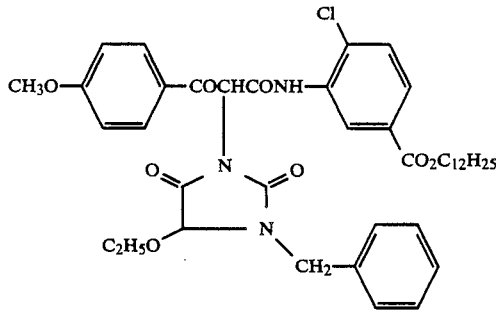

Hardener C-8

$(CH_2{=}CHSO_2CH_2CONHCH_2)_2$

15th layer: 2nd protective layer (gelatin protective layer)

Furthermore, 4-hydroxy-6-methyl-1,3,3*a*,7-tetrazaindene (stabilizer) ($3\times10^{-3}$ mol/Agmol), hardening agent C-8 (2 wt% of the weight of the gelatin) and a coating aid (1 wt% of the weight of the gelatin) were successively added to each emulsion layers to prepare a sample 1 (comparison).

Sensitizing dye A

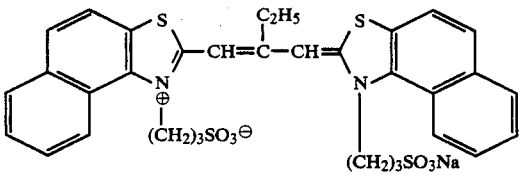

Sensitizing dye B

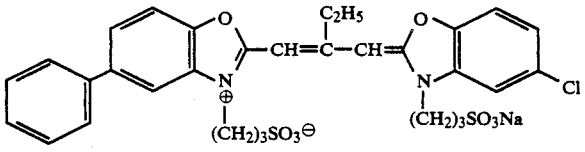

-continued
Sensitizing dye C
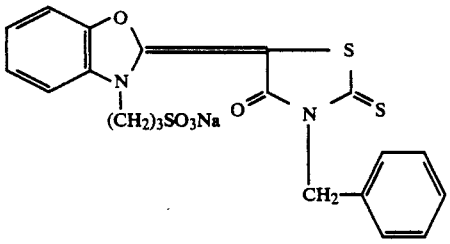
Coupler C-1
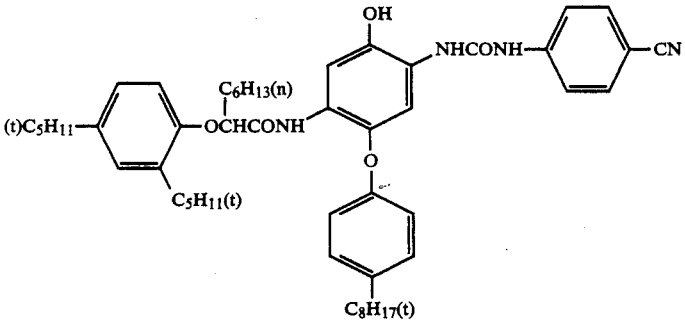
Coupler C-2
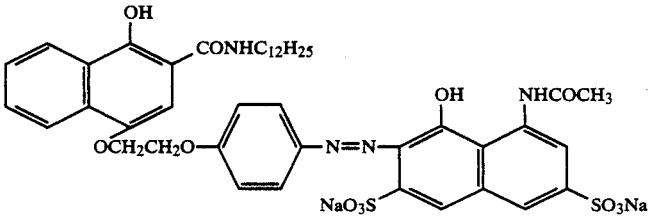
Coupler C-3
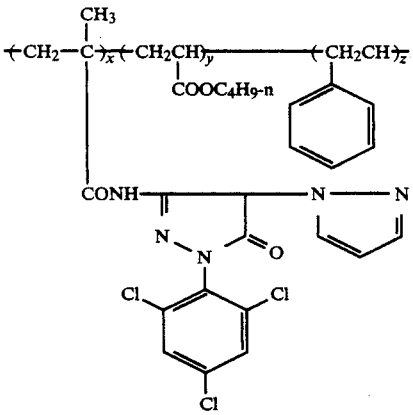
x:y:z = 1:2:2
molecular weight, about 50,000
Coupler C-4
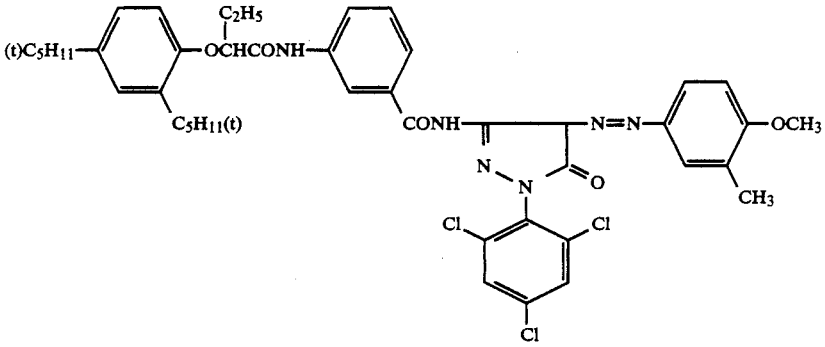

-continued

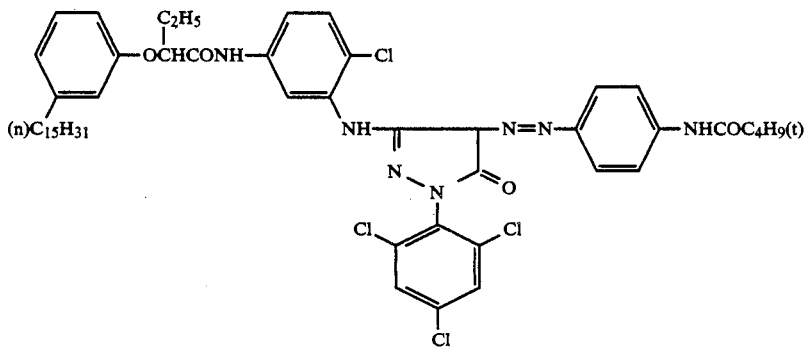

Coupler C-5

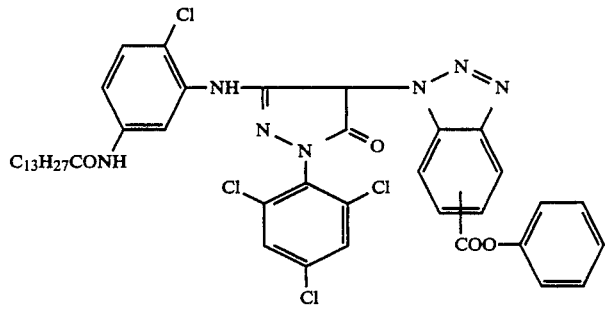

Coupler C-6

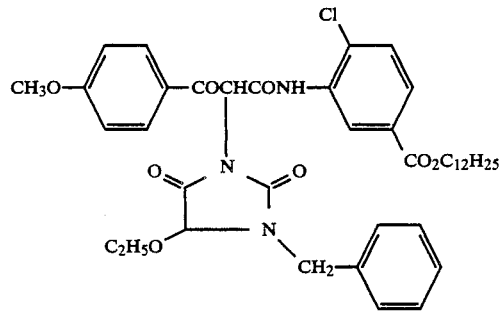

Coupler C-7

$(CH_2{=}CHSO_2CH_2CONHCH_2)_2$

Hardener C-8

Sample 2 was prepared in the same way as in the preparation of sample 1 except that the sensitizing dye A was added at 50° C. in the production of the third to fifth layers.

Sample 3 was prepared in the same way as in the preparation of sample 1 except that the sensitizing dye B was added at 50° C. in the preparation of the 7th to 9th layers.

Sample 4 was prepared in the same way as in the preparation of sample 1 except that the sensitizing dye C was added at 50° C. in the preparation of the 11th to 13th layers.

Sample 5 was prepared in the same way as in the preparation of sample 1 except that the sensitizing dye A for the third to fifth layers and the sensitizing dye B for the 7th to 9th layers were added each at 50° C.

Sample 6 was prepared in the same way as in the preparation of sample 1 except that the sensitizing dye A for the third to fifth layers and the sensitizing dye C for the 11th to 13th layers were each added at 50° C.

Sample 7 was prepared in the same way as in the preparation of sample 1 except that the sensitizing dye B for the 7th to 9th layers and the sensitizing dye C for the 11th to 13th layers were each added at 50° C.

Sample 8 was prepared in the same way as in the preparation of sample 1 except that the sensitizing dye A for the 3rd to 5th layers, the sensitizing dye B for the 7th to 9th layers, and the sensitizing dye C for the 11th to 13th layers were each added at 50° C.

Sample 9 was prepared in the same way as in the preparation of sample 1 except that the sensitizing dye A for the 3rd to 5th layers, the sensitizing dye B for the 7th to 9th layers, and the sensitizing dye C for the 11th to 13th layers were each added at 60° C.

Sample 10 was prepared in the same way as in the preparation of sample 1 except that the sensitizing dye A for the 3rd to 5th layers, the sensitizing dye B for the 7th to 9th layers, and the sensitizing dye C for the 11th to 13th layers were each added at 70° C.

Sample 11 was prepared as in the preparation of sample 1 except that the grain sizes in the 1st to 3rd red-sensitive layers, the 1st to 3rd green-sensitive layers and the 1st to 3rd blue-sensitive layers, the amount of the sensitizing dyes A, B and C added were changed as shown in Table 1.

Sample 12 was prepared as in the preparation of sample 1 except that the grain sizes in the 1st to 3rd red-sensitive layers, the 1st to 3rd green-sensitive layers and the 1st to 3rd blue-sensitive layers, the amount of the sensitizing dyes A, B and C added were changed as shown in Table 1.

Sample 13 was prepared as in the preparation of sample 1 except that the grain sizes in the 1st to 3rd red-sensitive layers, the 1st to 3rd green-sensitive layers and the 1st to 3rd blue-sensitive layers, the amount of the sensitizing dyes A, B and C added were changed as shown in Table 1.

Sample 14 was prepared as in the preparation of sample 1 except that the grain sizes in the 1st to 3rd red-sensitive layers, the 1st to 3rd green-sensitive layers and the 1st to 3rd blue-sensitive layers, the amount of the sensitizing dyes A, B and C added were changed as shown in Table 1.

Samples 1 to 14 were exposed for $10^{-5}$ second through a neutral gray wedge to a helium-cadmium (He-Cd) laser (wavelength 441.6 nm), an argon (Ar) laser light (wavelength 514.5 nm) and a helium-neon (He-Ne) laser light (wavelength 632.8 nm) by using a laser scanner (made by Dainippon Screen Co., Ltd.) equipped with a helium-cadmium (He-Cd) laser generating device (made by Kinmon Electrical Co., Ltd.), an argon (AR) laser generating device (made by Rexel Company), and a helium-neon (He-Ne) laser generating device (made by NEC).

The exposed samples were then each processed by the following method.

| Step | Temperature (°C.) | Time |
|---|---|---|
| (1) color development | 41.1 ± 0.1 | 3 minutes |
| (2) stopping | 27 to 38 | 30 seconds |
| (3) bleaching acceleration | 27 ± 1 | 30 seconds |
| (4) bleaching | 38 ± 1 | 3 minutes |
| (5) rinsing with water | 27 to 38 | 1 minute |
| (6) fixation | 38 ± 1 | 2 minutes |
| (7) rinsing with water | 27 to 38 | 2 minutes |
| (8) stabilization | 27 to 38 | 10 seconds |

The processing solutions used in the individual processing steps had the following compositions.

| | |
|---|---|
| (1) Color development | |
| Water at 21 to 38° C. | 850 ml |
| Kodak Anti-calcium No. 4 | 2.0 ml |
| Sodium sulfite (anhydrous) | 2.0 g |
| Eastman Antifog No. 9 | 0.22 g |
| Sodium bromide (anhydrous) | 1.20 g |
| Sodium carbonate (anhydrous) | 24.6 g |
| Sodium bicarbonate | 2.7 g |
| Developing agent in color development [4-(N-ethyl-N-(β-methanesulfonamido-ethyl)-m-toluidine] | 4.0 g |
| Water to make | 1.00 l |
| pH (27° C.) | 10.20 |
| (2) Stopping | |
| Water at 21 to 38° C. | 900 ml |
| 7.0 N sulfuric acid | 50 ml |
| Water to make | 1.00 l |
| pH (27° C.) | 0.9 |
| (3) Bleaching acceleration | |
| Water | 900 ml |
| Sodium meta-bisulfite (anhydrous) | 10.0 g |
| Glacial acetic acid | 25.0 ml |
| Sodium acetate | 10.0 g |
| EDTA-4Na | 0.7 g |
| PBA-1 | 5.5 g |
| Water to make | 1.0 l |
| pH (27° C.) | 3.8 ± 0.2 |
| (PBA-1 was 2-dimethylaminoethylisothiourea dihydrochloride.) | |
| (4) Bleaching | |

-continued

| | |
|---|---|
| Water at 24 to 38° C. | 800 ml |
| Gelatin | 0.5 g |
| Sodium persulfate | 33.0 g |
| Sodium chloride | 15.0 g |
| Sodium primary phosphate (anhydrous) | 9.0 g |
| Phosphoric acid (85%) | 2.5 ml |
| Water to make | 1.0 l |
| pH (27° C.) | 2.3 ± 0.2 |
| (6) Fixation | |
| Water at 20 to 38° C. | 700 ml |
| Kodak Anti-calcium No. 4 | 2.0 ml |
| 58% ammonium thiosulfate solution | 185 ml |
| Sodium sulfite (anhydrous) | 10.0 g |
| Sodium bisulfite (anhydrous) | 8.4 g |
| Water to make | 1.00 l |
| pH (27° C.) | 6.5 |
| (8) Stabilization | |
| Water at 21 to 27° C. | 1.00 l |
| Kodak stabilizer additive | 0.14 ml |
| Formalin (37.5% solution) | 1.50 ml |

The yellow image density, magenta image density and cyan image density of the samples exposed to the helium-cadmium (He-Cd) laser light (wavelength 441.6 nm) and processed in accordance with the above steps, the magenta image density, yellow image density and cyan image density of the samples exposed to the argon (Ar) laser light (wavelength 514.5 nm) and processed in accordance with the above steps, and the cyan image density, yellow image density and cyan image density of the samples exposed to the helium-neon (He-Ne) laser light (wavelength 632.8 nm) were measured, and the relative sensitivities were determined. The sensitivities were determined on the basis of the amounts of exposures at a density 0.2 above the fog density.

To evaluate color mixing, the color photographic material was exposed to the helium-neon laser light (632.8 nm) by an amount at which the red-sensitive emulsion layer of the photographic material colored to a density 0.5 above the fog density. The fog density was subtracted from each of the color densities of the blue-sensitive emulsion layer and the green-sensitive emulsion layer of the photographic material. The balances were divided by 0.5, to determine color mixing ratios of R→B and R→G, respectively.

Likewise, the color photographic material was exposed to the argon laser light (514.5 nm) by an amount at which the green-sensitive emulsion layer of the photographic material colored to a density 0.5 above the fog density. The fog density was subtracted from each of the color densities of the blue-sensitive emulsion layer and the red sensitive emulsion layer of the photographic material. The balances were divided by 0.5, to determine color mixing ratios of G→B and G→R, respectively.

Likewise, the color photographic material was exposed to the helium-cadmium laser light (441.6 nm) by an amount in which the blue-sensitive emulsion layer of the photographic material colored to a density 0.5 above the fog density. The fog density was subtracted from each of the color densities of the green-sensitive emulsion layer and the red-sensitive emulsion layer of the photographic material. The balances were divided by 0.5, to determine color mixing ratios of B→G and B→R, respectively.

The results are shown in Table 1. In the table, (") means the same as the value to the left.

Samples 8, 9 and 10 in accordance with the invention exhibited decreased color mixing in all layers as compared with the comparative samples 1 to 7.

Furthermore, samples 12, 13 and 14 of the invention in which the grain sizes in all layers were adjusted to not more than 0.4 μm were further decreased in color mixing as compared with the samples 8, 9 and 10 of the invention, and were excellent.

TABLE I-1

| Sample No. | 1* | 2* | 3* | 4* | 5* | 6* | 7* | 8** | 9** | 10** | 11* | 12** | 13** | 14** |
|---|---|---|---|---|---|---|---|---|---|---|---|---|---|---|
| Temperature at which the sensitizing dye A was added to the 3rd to 5th layers (°C.) | 40 | 50 | 40 | 40 | 50 | 50 | 40 | 50 | 60 | 70 | 40 | 50 | 60 | 70 |
| Temperature at which the sensitizing dye B was added to the 7th to 9th layers (°C.) | 40 | 40 | 50 | 40 | 50 | 40 | 50 | 50 | 60 | 70 | 40 | 50 | 60 | 70 |
| Temperature at which the sensitizing dye C was added to the 11th to 13th layers (°C.) | 40 | 40 | 40 | 50 | 40 | 50 | 50 | 50 | 60 | 70 | 40 | 50 | 60 | 70 |
| Grain size of the 1st red-sensitive layer (μm) | 0.25 | 0.25 | 0.25 | 0.25 | 0.25 | 0.25 | 0.25 | 0.25 | 0.25 | 0.25 | 0.1 | 0.1 | 0.1 | 0.1 |
| Grain size of the 2nd red-senstive layer (μm) | 0.43 | 0.43 | 0.43 | 0.43 | 0.43 | 0.43 | 0.43 | 0.43 | 0.43 | 0.43 | 0.15 | 0.15 | 0.15 | 0.15 |
| Grain size of the 3rd red-sensitive layer (μm) | 0.55 | 0.55 | 0.55 | 0.55 | 0.55 | 0.55 | 0.55 | 0.55 | 0.55 | 0.55 | 0.23 | 0.23 | 0.23 | 0.23 |
| Grain size of the 1st green-senstive layer (μm) | 0.3 | 0.3 | 0.3 | 0.3 | 0.3 | 0.3 | 0.3 | 0.3 | 0.3 | 0.3 | 0.1 | 0.1 | 0.1 | 0.1 |

TABLE I-2

| Sample No. | 1* | 2* | 3* | 4* | 5* | 6* | 7* | 8** | 9** | 10** | 11* | 12** | 13** | 14** |
|---|---|---|---|---|---|---|---|---|---|---|---|---|---|---|
| Grain size of the 2nd green-sensitive layer (μm) | 0.4 | 0.4 | 0.4 | 0.4 | 0.4 | 0.4 | 0.4 | 0.4 | 0.4 | 0.4 | 0.15 | 0.15 | 0.15 | 0.15 |
| Grain size of the 3rd green-sensitive layer (μm) | 0.5 | 0.5 | 0.5 | 0.5 | 0.5 | 0.5 | 0.5 | 0.5 | 0.5 | 0.5 | 0.19 | 0.19 | 0.19 | 0.19 |
| Grain size of the 1st blue-sensitive layer (μm) | 0.41 | 0.41 | 0.41 | 0.41 | 0.41 | 0.41 | 0.41 | 0.41 | 0.41 | 0.41 | 0.15 | 0.15 | 0.15 | 0.15 |
| Grain size of the 2nd blue-sensitive layer (μm) | 0.5 | 0.5 | 0.5 | 0.5 | 0.5 | 0.5 | 0.5 | 0.5 | 0.5 | 0.5 | 0.2 | 0.2 | 0.2 | 0.2 |
| Grain size of the 3rd blue-sensitive layer (μm) | 0.60 | 0.60 | 0.60 | 0.60 | 0.60 | 0.60 | 0.60 | 0.60 | 0.60 | 0.60 | 0.29 | 0.29 | 0.29 | 0.29 |
| Amount of sensitizing dye A added to the 1st red-sensitive layer (mole/mole of Ag) | $3.6 \times 10^{-3}$ | " | " | " | " | " | " | " | " | " | $9 \times 10^{-3}$ | " | " | " |
| Amount of sensitizing dye A added to the 2nd red-sensitive layer (mole/mole of Ag) | $1.7 \times 10^{-4}$ | " | " | " | " | " | " | " | " | " | $5 \times 10^{-4}$ | " | " | " |
| Amount of sensitizing dye A added to the 3rd red-sensitive layer (mole/mole of Ag) | $1.3 \times 10^{-4}$ | " | " | " | " | " | " | " | " | " | $3 \times 10^{-4}$ | " | " | " |

TABLE I-3

| Sample No. | 1* | 2* | 3* | 4* | 5* | 6* | 7* | 8** | 9** | 10** | 11* | 12** | 13** | 14** |
|---|---|---|---|---|---|---|---|---|---|---|---|---|---|---|
| Amount of sensitizing dye B added to the 1st green-sensitive layer (mole/mole of Ag) | $5 \times 10^{-4}$ | " | " | " | " | " | " | " | " | " | $1.5 \times 10^{-4}$ | " | " | " |
| Amount of sensitizing dye B added to the 2nd green-sensitive layer (mole/mole of Ag) | $3.4 \times 10^{-4}$ | " | " | " | " | " | " | " | " | " | $9 \times 10^{-4}$ | " | " | " |
| Amount of sensitizing dye B added to the 3rd green-sensitive layer (mole/mole of Ag) | $3.4 \times 10^{-4}$ | " | " | " | " | " | " | " | " | " | $9 \times 10^{-4}$ | " | " | " |
| Amount of sensitizing dye C added to the 1st blue-sensitive layer (mole/mole of Ag) | $1.1 \times 10^{-5}$ | " | " | " | " | " | " | " | " | " | $3 \times 10^{-5}$ | " | " | " |
| Amount of sensitizing dye C added to the 2nd blue-sensitive layer | $9 \times 10^{-6}$ | " | " | " | " | " | " | " | " | " | $2.2 \times 10^{-5}$ | " | " | " |

TABLE I-3-continued

| Sample No. | 1* | 2* | 3* | 4* | 5* | 6* | 7* | 8** | 9** | 10** | 11* | 12** | 13** | 14** |
|---|---|---|---|---|---|---|---|---|---|---|---|---|---|---|
| (mole/mole of Ag) Amount of sensitizing dye C added to the 3rd blue-sensitive layer (mole/mole of Ag) | $8 \times 10^{-6}$ | " | " | " | " | " | " | " | " | " | $1.8 \times 10^{-5}$ | " | " | " |

TABLE I-4

| Sample No. | 1* | 2* | 3* | 4* | 5* | 6* | 7* | 8** | 9** | 10** | 11* | 12** | 13** | 14** |
|---|---|---|---|---|---|---|---|---|---|---|---|---|---|---|
| Sensitizing of the red-sensitive layer (He—Cd laser) | 0.16 | 0.08 | 0.16 | 0.15 | 0.08 | 0.08 | 0.08 | 0.08 | 0.05 | 0.02 | 0.17 | 0.06 | 0.04 | 0.01 |
| Sensitizing of the blue-sensitive layer | | | | | | | | | | | | | | |
| Sensitizing of the green-sensitive layer (He—Cd laser) | 0.19 | 0.19 | 0.09 | 0.18 | 0.09 | 0.18 | 0.09 | 0.09 | 0.06 | 0.03 | 0.20 | 0.07 | 0.05 | 0.02 |
| Sensitizing of the blue-sensitive layer | | | | | | | | | | | | | | |
| Sensitizing of the blue-sensitive layer (Ar laser) | 0.18 | 0.18 | 0.17 | 0.09 | 0.17 | 0.09 | 0.17 | 0.09 | 0.06 | 0.03 | 0.19 | 0.07 | 0.05 | 0.02 |
| Sensitizing of the green-sensitive layer | | | | | | | | | | | | | | |
| Sensitizing of the red-sensitive layer (Ar laser) | 0.16 | 0.08 | 0.17 | 0.16 | 0.08 | 0.08 | 0.08 | 0.08 | 0.05 | 0.02 | 0.17 | 0.06 | 0.04 | 0.01 |
| Sensitizing of the green-sensitive layer | | | | | | | | | | | | | | |
| Sensitizing of the blue-sensitive layer (He—Ne laser) | 0.15 | 0.14 | 0.15 | 0.08 | 0.14 | 0.08 | 0.14 | 0.08 | 0.05 | 0.02 | 0.16 | 0.06 | 0.04 | 0.01 |
| Sensitizing of the red-sensitive layer | | | | | | | | | | | | | | |
| Sensitizing of the green-sensitive layer (He—Ne laser) | 0.16 | 0.15 | 0.09 | 0.16 | 0.08 | 0.15 | 0.08 | 0.08 | 0.05 | 0.02 | 0.17 | 0.06 | 0.04 | 0.01 |
| Sensitizing of the red-sensitive layer | | | | | | | | | | | | | | |

TABLE I-5

| Sample No. | 1* | 2* | 3* | 4* | 5* | 6* | 7* | 8** | 9** | 10** | 11* | 12** | 13** | 14** |
|---|---|---|---|---|---|---|---|---|---|---|---|---|---|---|
| Color mixing ratio of B→R (He—Cd laser) | 0.15 | 0.07 | 0.15 | 0.14 | 0.07 | 0.07 | 0.07 | 0.07 | 0.04 | 0.01 | 0.16 | 0.05 | 0.03 | 0.01 |
| Color mixing ratio of B→G (He—Cd laser) | 0.18 | 0.18 | 0.08 | 0.19 | 0.08 | 0.17 | 0.08 | 0.08 | 0.05 | 0.02 | 0.19 | 0.06 | 0.04 | 0.01 |
| Color mixing ratio of G→B (Ar laser) | 0.17 | 0.17 | 0.16 | 0.08 | 0.16 | 0.08 | 0.16 | 0.08 | 0.05 | 0.02 | 0.18 | 0.06 | 0.04 | 0.01 |
| Color mixing ratio of G→R (Ar laser) | 0.16 | 0.07 | 0.16 | 0.15 | 0.07 | 0.07 | 0.07 | 0.07 | 0.04 | 0.01 | 0.16 | 0.05 | 0.03 | 0.01 |
| Color mixing ratio of R→B (He—Ne laser) | 0.14 | 0.13 | 0.14 | 0.07 | 0.13 | 0.07 | 0.13 | 0.07 | 0.04 | 0.01 | 0.15 | 0.05 | 0.03 | 0.01 |
| Color mixing ratio or R→G (He—Ne laser) | 0.15 | 0.14 | 0.08 | 0.15 | 0.07 | 0.14 | 0.07 | 0.07 | 0.04 | 0.01 | 0.16 | 0.05 | 0.03 | 0.01 |

*Comparison
**Invention

While the invention has been described in detail and with reference to specific embodiments thereof, it will be apparent to one skilled in the art that various changes and modifications can be made therein without departing from the spirit and scope thereof.

What is claimed is:

1. A color photographic material comprising a support having thereon at least one red-sensitive silver halide emulsion layer, at least one green-sensitive silver halide emulsion layer and at least one blue-sensitive silver halide emulsion layer, wherein each of the silver halide emulsion layers is sensitized by adding at least one sensitizing dye at 50° C. to 80° C., and with respect to helium-cadmium laser light having a wavelength of 441.6 nm, (1) the ratio of the sensitivity of the green-sensitive emulsion layer to that of the blue-sensitive emulsion layer is at most 0.1 and (2) the ratio of the sensitivity of the red-sensitive emulsion layer to that of the blue-sensitive emulsion layer is at most 0.10;

with respect to argon laser light having a wavelength of 514.5 nm, (1) the ratio of the sensitivity of the blue-sensitive emulsion layer to that of the green-sensitive emulsion layer is at most 0.1 and (2) the ratio of the sensitivity of the red-sensitive emulsion layer to that of the green-sensitive emulsion layer is at most 0.10; and with respect to helium-neon laser light having a wavelength of 632.8 nm, (1) the ratio of the sensitivity of the blue-sensitive emulsion layer to that of the red-sensitive emulsion layer is at most 0.1 and (2) the ratio of the sensitivity of the green-sensitive emulsion layer to that of the red-sensitive emulsion layer is at most 0.10.

2. The color photographic material as claimed in claim 1, wherein with respect to helium-cadmium laser light, (1) the ratio of the sensitivity of the green-sensitive emulsion layer to that of the blue-sensitive emulsion layer is at most 0.08 and (2) the ratio of the sensitivity of the red-sensitive emulsion layer to that of the blue-sensitive emulsion layer is at most 0.08;

with respect to argon laser light, (1) the ratio of the sensitivity of the blue-sensitive emulsion layer to that of the green-sensitive emulsion layer is at most 0.08 and

(2) the ratio of the sensitivity of the red-sensitive emulsion layer to that of the green-sensitive emulsion layer is at most 0.08; and with respect to helium-neon laser light, (1) the ratio of the sensitivity of the blue-sensitive emulsion layer to that of the red-sensitive emulsion layer is at most 0.08 and (2) the ratio of the sensitivity of the green-sensitive emulsion layer to that of the red-sensitive emulsion layer is at most 0.08.

3. The color photographic material as claimed in claim 2, wherein with respect to helium-cadmium laser light, (1) the ratio of the sensitivity of the green-sensitive emulsion layer to that of the blue-sensitive emulsion layer is at most 0.05 and (2) the ratio of the sensitivity of the red-sensitive emulsion layer to that of the blue-sensitive emulsion layer is at most 0.05;

with respect to argon laser light, (1) the ratio of the sensitivity of the blue-sensitive emulsion layer to that of the green-sensitive emulsion layer is at most 0.05 and (2) the ratio of the sensitivity of the red-sensitive emulsion layer to that of the green-sensitive emulsion layer is at most 0.05; and with respect to helium-neon laser light, (1) the ratio of the sensitivity of the blue-sensitive emulsion layer to that of the red-sensitive emulsion layer is at most 0.05 and (2) the ratio of the sensitivity of the green-sensitive emulsion layer to that of the red-sensitive emulsion layer is at most 0.05.

4. The color photographic material as claimed in claim 3, wherein with respect to helium-cadmium laser light, (1) the ratio of the sensitivity of the green-sensitive emulsion layer to that of the blue-sensitive emulsion layer is at most 0.03 and (2) the ratio of the sensitive emulsion layer is at most 0.03;

with respect to argon laser light, (1) the ratio of the sensitivity of the blue-sensitive emulsion layer to that of the green-sensitive emulsion layer is at most 0.03 and (2) the ratio of the sensitivity of the red-sensitive emulsion layer to that of the green-sensitive emulsion layer is at most 0.03; and with respect to helium-neon laser light, (1) the ratio of the sensitivity of the blue-sensitive emulsion layer to that of the red-sensitive emulsion layer is at most 0.03 and (2) the ratio of the sensitivity of the green-sensitive emulsion layer to that of the red-sensitive emulsion layer is at most 0.03.

5. The color photographic material as claimed in claim 1, wherein each of said red-sensitive silver halide emulsion layer, said green-sensitive silver halide emulsion layer and said blue-sensitive silver halide emulsion layer comprise silver halide grains with an average grain size of from 0.01 to 0.4 μm.

6. The color photographic material as claimed in claim 5, wherein said silver halide grains have an average grain size of at most 0.3 μm.

7. The color photographic material as claimed in claim 6, wherein said silver halide grains have an average grain size of from 0.05 to 0.2 μm.

8. The color photographic material as claimed in claim 1, wherein said blue-sensitive emulsion layer, said red-sensitive emulsion layer, and said green-sensitive emulsion layer are disposed outwardly from said support in the order of blue-sensitive, red-sensitive and green-sensitive.

* * * * *